United States Patent [19]

Carter et al.

[11] 4,374,441

[45] Feb. 22, 1983

[54] METHOD OF MAKING A BOOK COVER AND POCKET ELEMENT THEREFOR

[75] Inventors: Leewood C. Carter, Warren; Robin P. Neary, Basking Ridge, both of N.J.; Jay C. Curtis, Wheaton, Ill.

[73] Assignee: Book Covers, Inc., Newark, N.J.

[21] Appl. No.: 152,798

[22] Filed: May 23, 1980

[51] Int. Cl.[3] ..... B42C 15/00

[52] U.S. Cl. ..... 412/3; 493/335; 493/346

[58] Field of Search ..... 493/346, 345, 945, 946, 493/947, 335, 381; 11/2, 1 D; 281/31

[56] References Cited

U.S. PATENT DOCUMENTS

| | | | |
|---|---|---|---|
| 2,539,755 | 1/1951 | Rogers et al. | 493/335 |
| 2,641,484 | 6/1953 | Brody | 11/2 X |
| 3,145,033 | 8/1964 | Caddoo | 11/2 X |
| 3,255,679 | 6/1966 | Eckels | 493/346 X |
| 3,399,096 | 8/1968 | Ranger | 493/335 X |
| 3,750,538 | 8/1973 | Confer | 493/335 |
| 3,972,764 | 8/1976 | Sendor | 11/2 X |

*Primary Examiner*—James F. Coan

*Attorney, Agent, or Firm*—Weinstein & Sutton

[57] ABSTRACT

In accordance with the present invention, there is provided a novel method of making a book cover including a pocket element wherein a continuous web of cardboard material and a continuous web of paper material are supplied to a work station where they are adhered to each other along their lateral edges. The composite web which is formed is then longitudinally slit at three spaced-apart locations to separate the composite web into first and second composite sections and to form pocket elements on each of the composite sections. These composite sections are then cut in a transverse direction at spaced intervals to form first and second book covers, wherein each of the book covers include its own pocket element adhered thereto.

5 Claims, 5 Drawing Figures

METHOD OF MAKING A BOOK COVER AND POCKET ELEMENT THEREFOR

FIELD OF THE INVENTION

The invention relates generally to a method of making book covers, and more particularly, to book covers which include preformed pocket elements for having material inserted therein.

BACKGROUND OF THE INVENTION

Book covers are formed from laminated paperboard which typically include a central spine section and hinges on either side of the spine section for opening and closing the book covers. It is well known to have the back book cover include a pocket element formed thereon, wherein the pocket element is adhered along three of its edges to three corresponding edges of the paperboard blank to form the pocket. Typically, the pocket element is formed by adhering heavy-duty paper or paperboard to the inner surface of the book cover.

Although book covers having pocket elements are well known, they are presently constructed in an inefficient manner. That is, the heavy-duty paper or paperboard material for forming the pocket element is typically precut and then adhered along three of its edges to a precut sheet of laminated paperboard material which forms the book cover. As such book covers and pocket elements are formed one at a time, it would be highly desirable to increase the efficiency of the method of making such book covers including pocket elements.

Accordingly, it is an object of the present invention to provide a novel method for forming book covers including pocket elements which overcomes one or more of the aforesaid problems. Specifically, it is within the contemplation of the present invention to provide an improved method of making a book cover including a pocket element, wherein the book cover and pocket element are formed in a continuous process from continuous webs of material.

It is also an object of the present invention to provide a novel and efficient method of continuously forming book covers and pocket elements therefor.

SUMMARY OF THE PRESENT INVENTION

Briefly, in accordance with the principles of the present invention, there is provided a method of making a book cover including a pocket element, which includes the steps of supplying a continuous web of cardboard material to a work station, wherein the cardboard web has first and second surfaces, and wherein the first surface includes first and second lateral edges for adhering the continuous web of cardboard material to a continuous web of paper. More particularly, the present method includes the step of superimposing a continuous web of paper on the first surface of the continuous web of cardboard material. As the webs of cardboard and paper are brought together, they are adhered along the first and second lateral edges of the cardboard web so as to form a continuous composite web.

Once the composite web is formed, three slitter blades are brought into engagement with the composite web. First and second spaced-apart slitter blades are employed to form spaced-apart first and second longitudinally-extending slits in the paper web. The paper material which remains between the first and second slits is removed, and the remaining sections of the paper web define first and second pocket elements.

A third slitter blade is also employed to form a third slit along the center of the composite web to separate the cardboard web into first and second composite sections. These sections are then cut transversely at spaced intervals to form first and second book covers, with the first book cover including the first pocket element, and the second book cover including the second pocket element.

The cardboard web is also provided with hinges for allowing the book cover to expand when material is inserted in the pocket elements. This avoids damage to the hinge between the book cover and spine.

Accordingly, as a result of the present invention, a novel and efficient method is provided for forming book covers which include pocket elements in a continuous manner. That is, the laminated paperboard for the book cover is continuously supplied, and the heavy-duty paper for forming the pocket element is also continuously supplied, and both are continuously adhered together to form the continuous composite web. The slitting operations are also performed continuously, so that a completely continuous process is provided for mass producing book covers which include the pocket elements. In addition, as a result of the present invention, the hinges for allowing the book cover to expand are included in the continuously-processed web.

BRIEF DESCRIPTION OF THE DRAWINGS

Further objects, features, and advantages of the present invention will become apparent upon the consideration of the following detailed description of a presently-preferred embodiment when taken in conjunction with the accompanying drawings, wherein.

DETAILED DISCUSSION OF PREFERRED EMBODIMENT OF THE INVENTION

Figure 1:
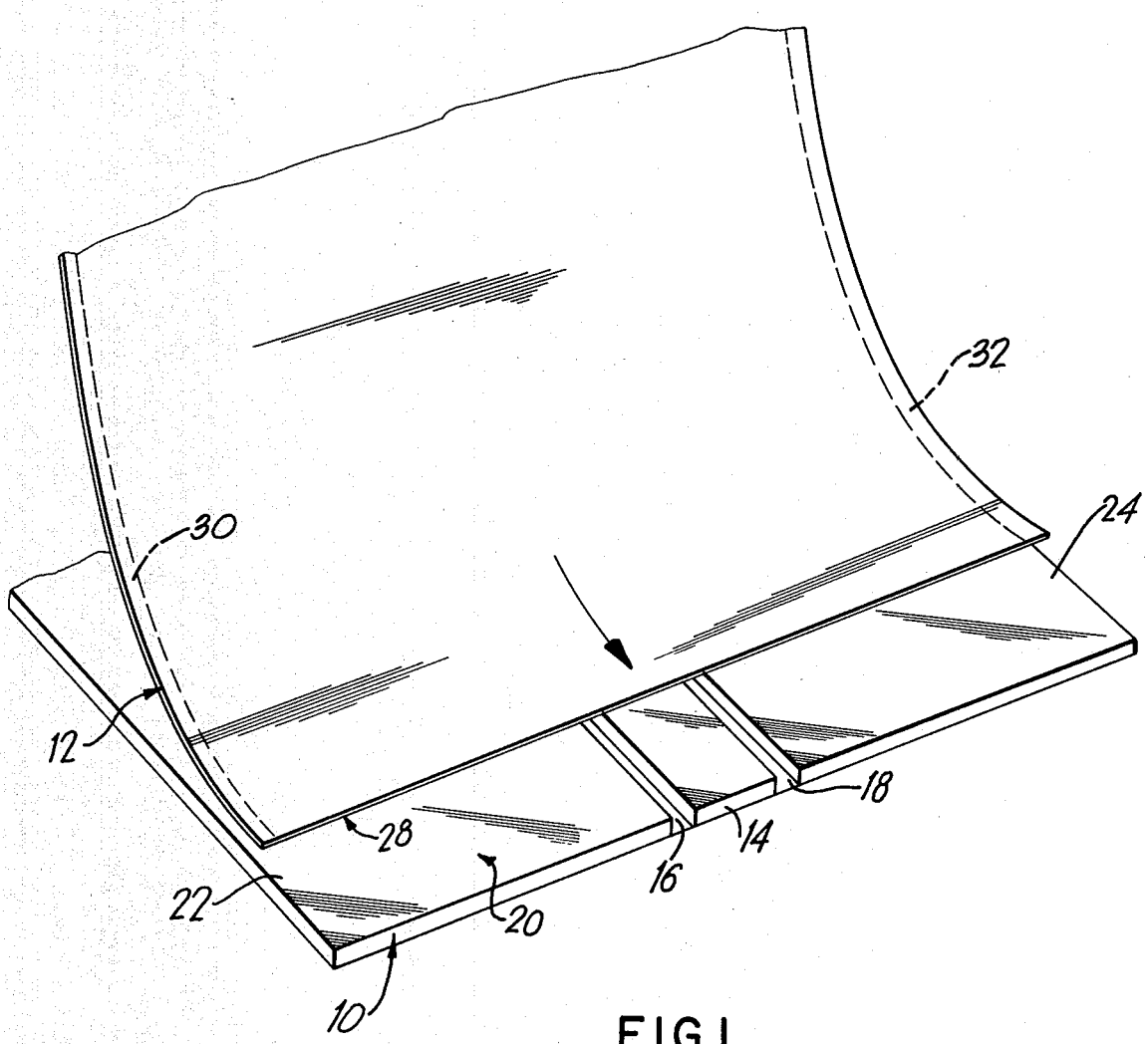
FIG. 1 is a perspective view of a continuous web of paper material being superimposed on a continuous web of paperboard material.

Referring now to FIG. 1, there is shown a continuous web 10 of cardboard material being supplied to a work station and having superimposed thereon a continuous web 12 of paper. The continuous web 10 of cardboard material is preferably formed from a plurality of layers of laminated paperboard, such as 100 point laminated paperboard. A central spine 14 is formed in the web 10, and on either side thereof, spaces 16, 18 define hinges. Such spaces may be formed by removing a plurality of the layers from the web 10. Such hinges 16, 18 extend in a longitudinal direction in the web 10 and extend parallel to the longitudinally-extending spine 14 which is formed between the hinges 16, 18.

The paperboard web 10 has an upper surface 20 which includes a first lateral edge 22 and a second lateral edge 24, which lateral edges also extend in a longitudinal direction on upper surface 20. Such longitudinally-extending lateral edges 22, 24 define glue areas on surface 20 of the web 10, for a purpose to be explained.

The continuous web 12 of paper is continuously supplied, and it is superimposed on the continuous web 10 of paperboard material, so that the lower surface 28 of the paper web 12 is brought into contact with the upper surface 20 of the continuous web of cardboard 10. Preferably, the paper web 12 is of 20 point paper and, as will be explained herein, is employed to form the pocket elements for the book covers.

Figure 2:
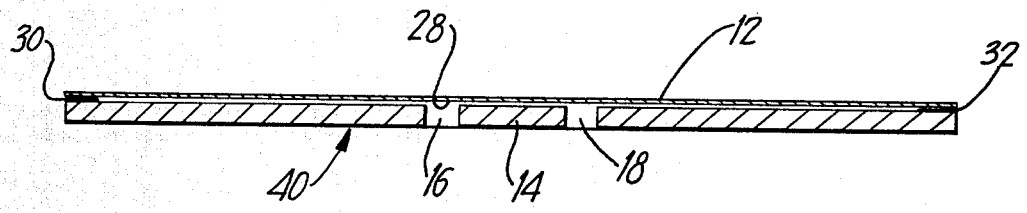
FIG. 2 is a cross-sectional view illustrating the continuous web of paper material adhered to the continuous web of cardboard material.

The paper web 12 also includes longitudinally-extending lateral edges 30, 32 formed on either side of the paper web 12, and such lateral edges 30, 32 extend on the opposite lateral edges of surface 28 of paper web 12. Before paper web 12 is superimposed on cardboard web 10, a suitable adhesive, such as glue, is applied to both of the longitudinally-extending lateral edges 30, 32. Such adhesive or glue may be applied to paper web 12, in any suitable manner, such as by rollers or the like. In this manner, when paper web 12 is superimposed on cardboard web 10, they are adhered together to form a continuous composite web 40, as shown in FIG. 2.

Figure 3:
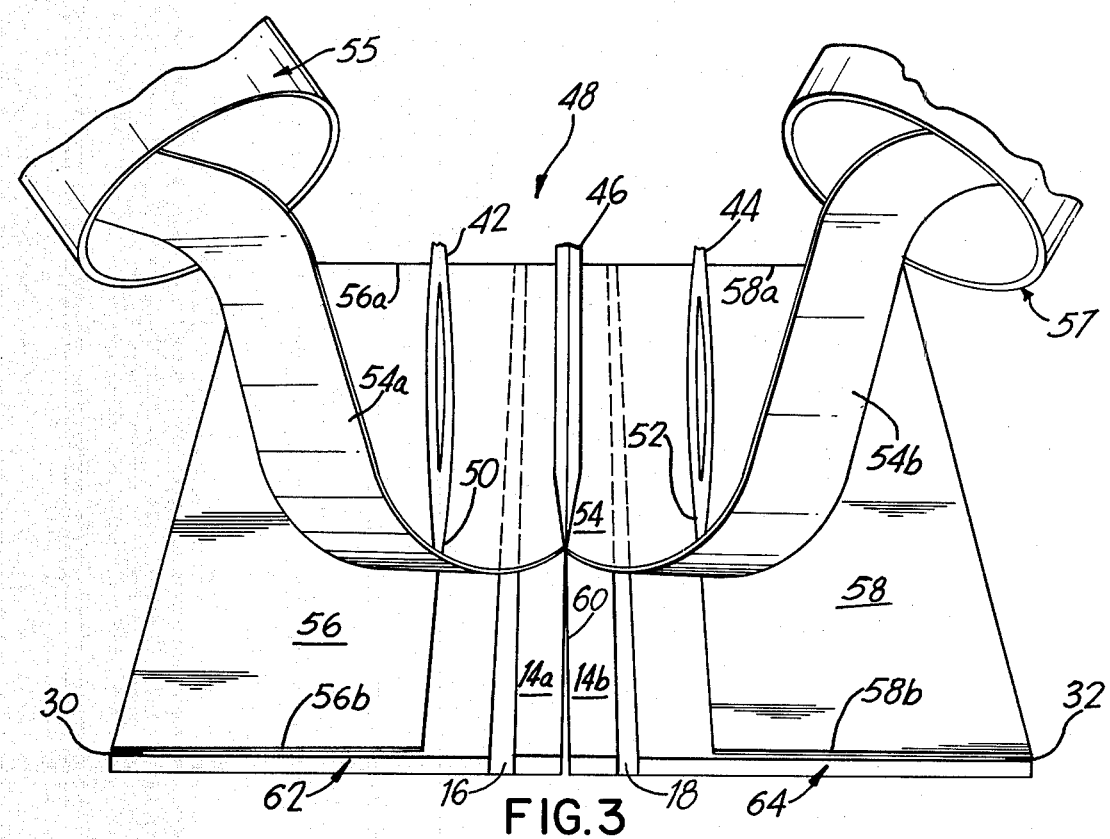
FIG. 3 is a perspective view illustrating the operation of the slitter blades for removing the central section of the paper material to define the pocket elements.
Figure 4:
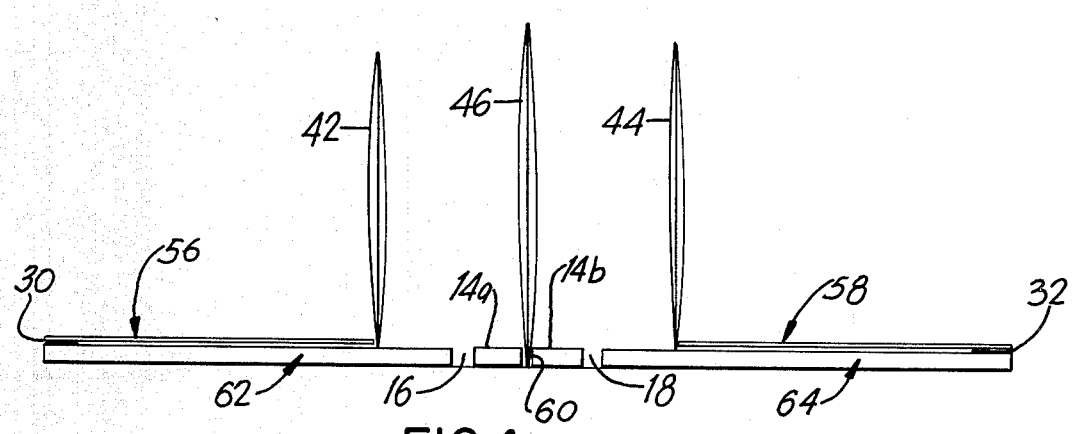
FIG. 4 is a cross-sectional view more clearly illustrating the relative position of the slitter blades and their engagement with the composite web.

Referring now to FIGS. 3 and 4, there is shown a plurality of slitter blades or cutting wheels 42, 44, and 46, which define a cutting station 48. Such cutting wheels or slitter blades may be mounted in any suitable manner for engagement with the composite web 40 as it passes the cutting station 48.

As shown in FIGS. 3 and 4, outer cutting wheels 42, 44 are employed to form longitudinally-extending slits 50, 52 in paper web 12 at spaced-apart locations. In this manner, the central section 54 of the paper web 12 may be removed from the composite web 40 so that a paper section 56 remains on one side of slit 50, and a paper section 58 remains on the other side of slit 52. As will be explained herein, paper sections 56, 58 define the pocket elements for the book covers.

In addition, centrally-disposed cutting wheel or slitter blade 46 cuts through the paper web 12 and also cuts through the cardboard web 10 along a longitudinally-extending slit 60 to divide composite web 40 into separate book cover sections 62, 64. As will be noted, the central spine 14 is also divided into two sections **14*a*, 14*b***.

As will be seen in FIG. 3, suitable apparatus may be provided for removing the central section 54 of paper web 12 from composite web 40. As cutting wheel 46 is disposed above the composite web 40, it also cuts through the paper web 12 and divides central paper section 54 into strips **54*a*, 54*b*. Any suitable apparatus may be employed to remove continuous strips 54*a*, 54*b* of paper from the composite web after they are slit. For example, vacuum sources 55, 57 will lift strips 54*a*, 54*b* out of contact with the web 40, so that the web 40 can continue to move along without strips 54*a*, 54*b*** in contact therewith.

In the next step of the process, the composite web 40 is cut transversely at spaced-apart locations by any suitable cutting apparatus to form the book cover sections 62, 64.

Figure 5:
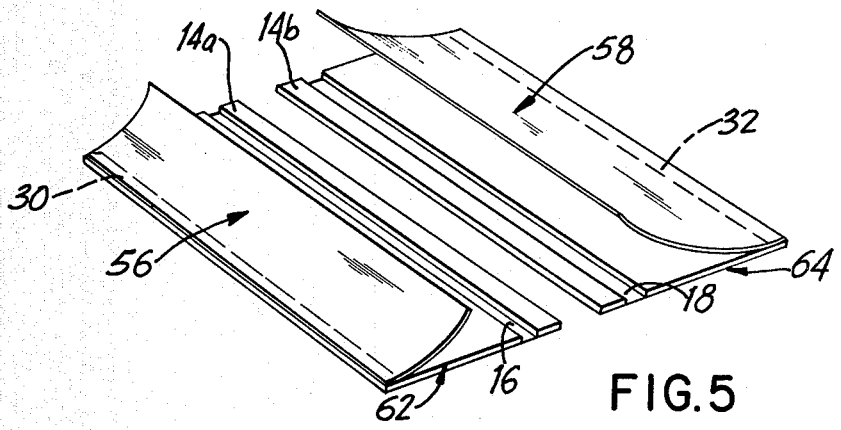
FIG. 5 is a perspective view of a pair of book covers and pocket elements formed as a result of the method of the present invention.

As shown in FIG. 5, as a result of the foregoing arrangement, the composite web 40 is divided into two separate book cover sections 62, 64. As will be noted, book cover section 62 includes longitudinally-extending hinge 16, spine section **14*a*, and paper sheet 56 adhered thereto along lateral edge 30 by adhesive or glue to form the pocket element. Similarly, book cover section 64 includes longitudinally-extending hinge 18, spine section 14*b*, and paper sheet 58 adhered thereto along lateral edge 32** by suitable adhesive or glue to form the pocket element.

Each of the book cover sections 62, 64 is then ready to be supplied to the case maker for forming each book cover section into the back cover of a book. In order to complete this process, the unadhered edges **56*a*, 56*b* of pocket element 56 must be adhered to the corresponding edges of book cover section 62. Similarly, the unadhered edges 58*a*, 58*b* of pocket element 58 must be adhered to the corresponding edges of book cover section 64. In this manner, when paper sections 56, 58 are adhered to their respective book cover sections 62, 64** along three edges, they each define suitable pocket elements for each of the book cover sections for receiving material therein.

In addition, the hinge sections 16, 18 of the book cover sections 62, 64, respectively, allow the back covers to expand when the respective pocket elements receive material therein. That is, spine section **14*a* pivots about hinge 16 so that spine 14*a* may compensate for the thickness of the material to be inserted in pocket element 56. This is also the case for book cover 64**. In this manner, the back cover can expand to receive additional material in the pocket elements without breaking the hinge of the book cover.

Advantageously, as a result of the present invention, a continuous process is provided for forming continuous webs of paper and paperboard material into pairs of back covers for books, with each of the back covers including preformed pocket elements. As a further advantage of the present invention, the back covers include longitudinally-extending hinges which allow the covers to expand when the pocket elements receive material therein, which substantially avoids the possibility of the hinge between the back cover and the spine being damaged or torn in use, as additional material is added to the pocket-receiving elements.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A method of making a book cover including a pocket element, comprising the steps of:

supplying a continuous web of cardboard material to a work station, said cardboard material having first and second surfaces, and first and second longitudinally-extending lateral edges on said first surface;

superimposing a continuous web of paper on said first surface;

adhering said first and second lateral edges of said cardboard web and said paper web to form a continuous composite web;

forming spaced-apart, first and second longitudinally-extending slits in said continuous paper web to define first and second pocket elements;

forming a third slit along the center of said cardboard web to separate said composite web into first and second composite sections;

cutting said first and second composite sections in a transverse direction at spaced intervals to form first and second book covers, said first book cover including said first pocket element adhered thereto, and said second book cover including said second pocket element adhered thereto.

2. The method of claim 1 further including the step of forming spaced-apart, first and second longitudinally-extending hinges in said cardboard web to define a spine section between said first and second hinges.

3. The method of claim 2, wherein the step of forming a third slit includes the step of cutting through the center of said spine section to form first and second spine sections for said first and second book covers, respectively.

4. The method of claim 1 further including the step of attaching one or more unadhered edges of said pocket elements to said book covers, respectively.

5. The method of claim 1 wherein the step of adhering includes the step of applying adhesive to said paper web before adhering said paper web to said cardboard web.

* * * * *